US009202319B2

(12) United States Patent
Chinnadurai et al.

(10) Patent No.: US 9,202,319 B2
(45) Date of Patent: Dec. 1, 2015

(54) DIAGNOSTIC TOOL WITH A PLURALITY OF OPERATING SYSTEMS

(71) Applicant: Service Solutions U.S. LLC, Warren, MI (US)

(72) Inventors: Manokar Chinnadurai, Owatonna, MN (US); Reed Selkirk, Kalamazoo, MI (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 55 days.

(21) Appl. No.: 13/841,111

(22) Filed: Mar. 15, 2013

(65) Prior Publication Data

US 2014/0277922 A1 Sep. 18, 2014

(51) Int. Cl.
*G07C 5/00* (2006.01)
*G07C 5/08* (2006.01)

(52) U.S. Cl.
CPC ..... *G07C 5/0808* (2013.01); *G07C 2205/02* (2013.01)

(58) Field of Classification Search
USPC ..... 701/33.4, 33.3, 33.2, 34.3, 31.4, 34.4
See application file for complete search history.

(56) References Cited

U.S. PATENT DOCUMENTS

| | | | | |
|---|---|---|---|---|
| 6,937,926 | B2 | 8/2005 | Lipscomb et al. | |
| 6,976,193 | B2 | 12/2005 | Dubal | |
| 6,980,947 | B2 | 12/2005 | Cabezas et al. | |
| 8,433,463 | B1 * | 4/2013 | Lieberman et al. | 701/21 |
| 8,565,963 | B2 * | 10/2013 | Burke, Jr. | 701/33.4 |
| 8,793,049 | B2 * | 7/2014 | Brozovich | 701/33.2 |
| 2006/0058658 | A1 | 3/2006 | King et al. | |
| 2011/0113219 | A1 | 5/2011 | Golshan et al. | |
| 2014/0121891 | A1 * | 5/2014 | Barrett et al. | 701/33.2 |

* cited by examiner

*Primary Examiner* — Richard Camby
(74) *Attorney, Agent, or Firm* — Baker & Hostetler LLP

(57) ABSTRACT

A diagnostic tool may include a user interface operating system comprising a computer processor that operates in a first operating environment. The diagnostic tool may also include a vehicle diagnostic operating system comprising a computer processor that operates in a second operating environment, wherein the second operating environment is different from the first operating environment.

19 Claims, 3 Drawing Sheets

DIAGNOSTIC TOOL WITH A PLURALITY OF OPERATING SYSTEMS

FIELD OF THE DISCLOSURE

The present disclosure relates generally to a diagnostic tool for diagnosing a vehicle. More particularly, the present disclosure relates to a diagnostic tool having a plurality of operating systems for diagnosing a vehicle.

BACKGROUND OF THE DISCLOSURE

In many industries, diagnostic systems play an increasingly important role in manufacturing processes, as well as in maintenance and repair throughout the lifetime of the equipment or product. Some diagnostic systems are based on personal computer technology and feature user-friendly, menu-driven diagnostic applications. These systems assist technicians and professionals at all levels in performing system diagnostics.

With equipment and products becoming more advanced, more complex, and more expensive with the addition of electronic components the knowledge base and financial resources required to properly use, maintain, and fix these items have grown immensely. Different diagnostic systems are built with varying capabilities to perform various functions. For example, some diagnostic systems may include a simple code reader, while other diagnostic systems include complex computer architectures. Also, different operating systems have been developed with advancement of diagnostic systems. Oftentimes, different operating systems are not compatible with each other and thus requires user to purchase different diagnostic systems for different applications.

Accordingly, it is desirable to provide a diagnostic tool having a plurality of operating systems. Also, it is desirable to provide a diagnostic tool having a plurality of operating systems that may be used for different applications.

SUMMARY OF THE INVENTION

The foregoing needs are met, to a great extent, by the present invention, wherein in one aspect an apparatus is provided that in some embodiments include a diagnostic tool having a plurality of operating systems for diagnosing a vehicle.

In accordance with one embodiment of the present disclosure, a diagnostic tool may include a user interface operating system comprising a computer processor that operates in a first operating environment. The diagnostic tool may also include a vehicle diagnostic operating system comprising a computer processor that operates in a second operating environment, wherein the second operating environment is different from the first operating environment.

In accordance with another embodiment of the present disclosure, a diagnostic tool may include a user interface operating system comprising a computer processor that operates in a first operating environment, wherein the first operating environment is the same operating environment as an operating environment of an external device coupled to the diagnostic tool. The diagnostic tool may also include a vehicle diagnostic operating system comprising a computer processor that operates in a second operating environment, wherein the second operating environment is different from the first operating environment.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
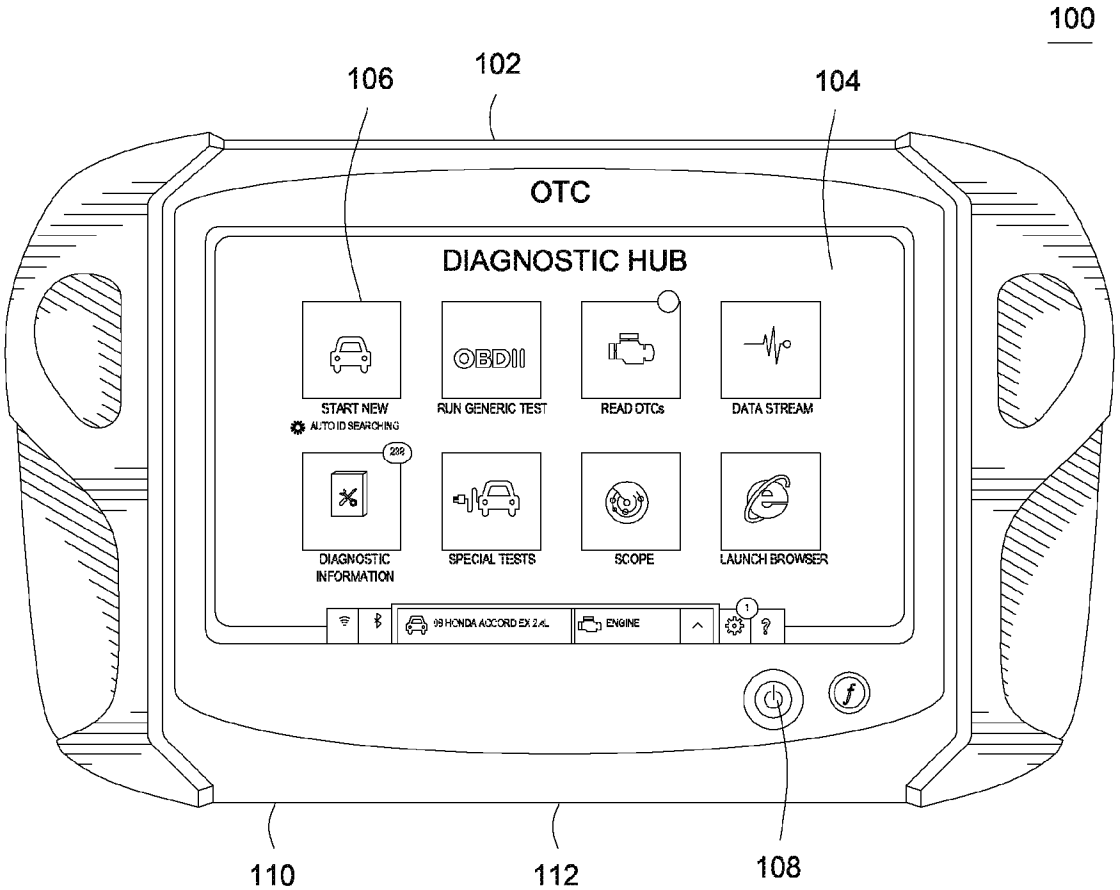
FIG. 1 depicts a front view of a diagnostic tool according to an exemplary embodiment of the present disclosure.

The invention will now be described with reference to the drawing figures, in which like reference numerals refer to like parts throughout. An embodiment in accordance with the present invention provides a diagnostic tool having a plurality of operating systems. For example, the diagnostic tool may include a user interface operating system that may be operated in an environment native to an operating system of different external devices. Also, a diagnostic tool may include a vehicle diagnostic operating system that may execute various functions of the diagnostic tool.

An embodiment of the present inventive system is illustrated in FIG. 1. In particular, FIG. 1 is a front view illustrating a diagnostic tool 100 according to an embodiment of the invention. The diagnostic tool 100 may be any computing device, including a computer, a personal computer, a laptop, a cellular communication device, a workstation, a mobile device, a smart phone, a television, a tablet, a personal digital assistant (PDA), a thin client system, a fat client system, a network appliance, a gaming console, a wearable mounted device, an Internet computing device, a global positioning system (GPS), a range finder, or other any other computing device. In some embodiments, the diagnostic tool 100 may be part of a power tool, security systems, or the like. The power tool may include, drills, saws, impact drivers, compressors, grinder, sander, joiner, cutter, wrench, hammer, blower, rotary tools, pneumatic tools, measuring tools, fluid electronic timers, routers, oscillating tools, cleaner and the like. The diagnostic tool 100 may include software in order to diagnose problems of the equipment under test. In another example, the diagnostic tool 100 may be, the Genisys® Touch diagnostic tool from Service Solutions U.S. LLC in Owatonna, Minn. or Elite Autoscanner®Pro CP9190 from Actron (a unit of Service Solutions).

The diagnostic tool 100 may include a housing 102 to house the various components of the diagnostic tool 100, such as a display 104, a user interface 106, a power key 108, a memory card reader 110 (optional) and a connector interface 112. The display 104 can be any display, for example, a liquid crystal display (LCD), light emitting diode (LED), organic light emitting diode (OLED), a video graphics array (VGA), a touch display (which can also be a user interface), etc. The user interface 106 may allow the user to interact with the diagnostic tool 100 in order to operate the diagnostic tool 100 as desired. The user interface 106 may include touch screen icons, function keys, arrow keys or any other type of keys that may manipulate the diagnostic tool 100 in order to operate various menus that may be presented on the display 104. The user interface 106 may also include a mouse or any other suitable input device, including a keypad, or a scanner. The user interface 106 can also include numbers or alphanumeric. The power key 108 may allow the user to turn the diagnostic tool 100 on and off, as required.

Memory card reader 110 may be a single type card reader for a memory card, such as a compact flash card, floppy disc, memory stick, secure digital memory, flash memory or other types of memory. The memory card reader 110 may be a reader that reads more than one of the aforementioned memory such as a combination memory card reader. Additionally, the memory card reader 110 may also read any other computer readable medium, such as CD, DVD, UMD, etc.

The connector interface 112 may allow the diagnostic tool 100 to connect to an external device, such as an ECU of a vehicle (via a data link connector), a sensor, a computing device, an external communication device (such as a modem), a network, etc. through a wired or wireless connection. Connector interface 112 may also include a USB, FIREWIRE, modem, RS232, RS485, and other connections to communicate with external devices, such as a hard drive, USB drive, CD player, DVD player, UMD player or other computer readable medium devices.

Figure 2:
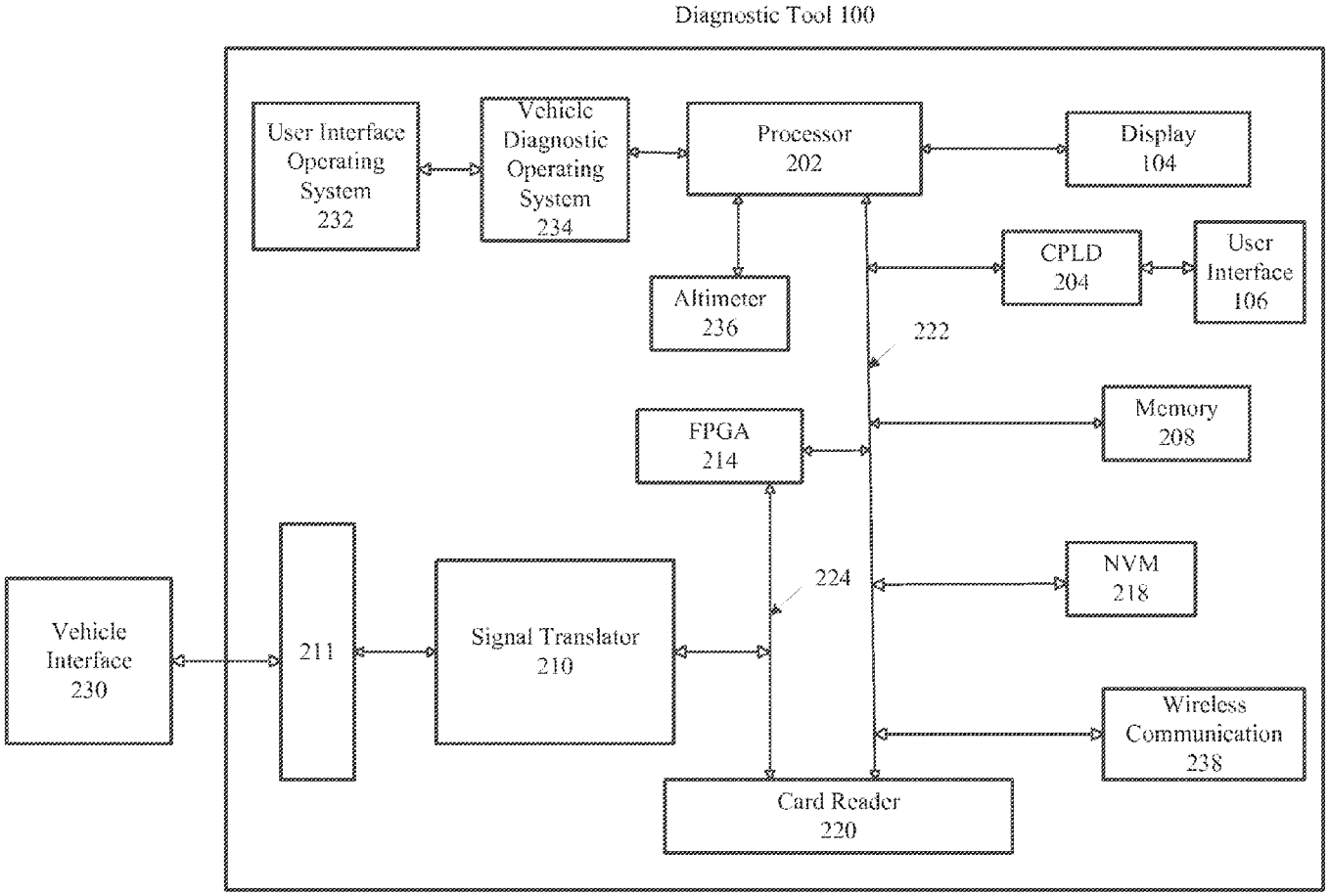
FIG. 2 depicts components of a diagnostic tool according to an exemplary embodiment of the present disclosure.

FIG. 2 is a block diagram of the components of the diagnostic tool 100 according to an embodiment of the present disclosure. In FIG. 2, the diagnostic tool 100 according to an embodiment of the present disclosure may include processors 202 and 240, a field programmable gate array (FPGA) 214, a first system bus 224, the display 104, a complex programmable logic device (CPLD) 204, the user interface 106, a memory subsystem 208, an internal non-volatile memory (NVM) 218, a card reader 220, a second system bus 222, a connector interface 211, a selectable signal translator 210, a user interface operating system 232, a vehicle diagnostic operating system 234, an optional altimeter 236 and wireless communication circuit 238. A vehicle communication interface 230 is in communication with the diagnostic tool 100 through connector interface 211 via an external cable (not shown).

Selectable signal translator 210 may communicate with the vehicle communication interface 230 through the connector interface 211. Selectable signal translator 210 may condition signals received from an ECU unit through the vehicle communication interface 230 to a conditioned signal compatible with diagnostic tool 100. Selectable signal translator 210 may communicate with, for example, the following communication protocols: J1850 (VPM and PWM), ISO 9141-2 signal, communication collision detection (CCD) (e.g., Chrysler collision detection), data communication links (DCL), serial communication interface (SCI), S/F codes, a solenoid drive, J1708, RS232, Controller Area Network (CAN), Keyword 2000 (ISO 14230-4), OBD II or other communication protocols that are implemented in a vehicle.

The circuitry to translate and send in a particular communication protocol can be selected by FPGA 214 (e.g., by tri-stating unused transceivers) or by providing a keying device that plugs into the connector interface 211 that may be provided by diagnostic tool 100 to communicatively connect diagnostic tool 100 to vehicle communication interface 230. Selectable signal translator 210 may be also coupled to FPGA 214 and the card reader 220 via the first system bus 224. FPGA 214 may transmit to and receive signals (i.e., messages) from the ECU unit through selectable signal translator 210.

The FPGA 214 may be coupled to the processor 202 through various address, data and control lines by the second system bus 222. The FPGA 214 also may be coupled to the card reader 220 through the first system bus 224. The processor 240 may be coupled to the display 104 via the user interface operating system 232 in order to output the desired information to the user. The processor 240 may communicate with the CPLD 204. Additionally, the processor 240 may be programmed to receive input from the user through the user interface 106 via the CPLD 204. The CPLD 204 may provide logic for decoding various inputs from the user of diagnostic tool 100 and glue-logic for various other interfacing tasks.

Memory subsystem 208 and internal non-volatile memory (NVM) 218 may be coupled to the second system bus 222, which may allow for communication with the processor 202 and FPGA 214. Memory subsystem 208 can include an application dependent amount of dynamic random access memory (DRAM), a hard drive, flash drive such as MSATA, EMMC, SC card and/or read only memory (ROM). Software to run the diagnostic tool 100 can be stored in the memory subsystem 208, including any database. The database may include operating environments of various user interface operating systems of different external devices and vehicle diagnostic operating systems of the diagnostic tool 100. The database can also be stored on an external memory, such as a storage area in an internet cloud, SD memory card, USB memory, a compact flash card or other memories.

Internal non-volatile memory 218 can be an electrically erasable programmable read-only memory (EEPROM), flash ROM, or other similar memory. Internal non-volatile memory 218 can provide, for example, storage for boot code, self-diagnostics, various drivers and space for FPGA images, if desired. If less than all of the modules are implemented in FPGA 214, internal non-volatile memory 218 can contain downloadable images so that FPGA 214 can be reconfigured for a different group of communication protocols.

The user interface operating system 232 may include one or more computer processors and/or memory for storing various operating environments of operating systems of different external devices. For example, the user interface operating system 232 may include operating environments of iOS™, Android™, Window 8™, Window RT™, Blackberry 10™ and/or other operating systems of external devices that may be coupled to the diagnostic tool 100. For example, the external devices may include computing devices, smart phone, tablets, playbook, mobile devices and/or other devices that may be running in an operating environment. The user interface operating system 232 may be coupled to an external device that may be operated in a different operating system from the diagnostic tool 100. For example, the user interface operating system 232 may determine an operating system of an external device and the user interface operating system 232 may select an operating environment that may be compatible with the operating system of the external device. For example, an external device may utilize an iOS™ operating system and the user interface operating system 232 may operate in an iOS™ operating environment to interface with the external device. In another example, an external device may utilize an Android™ operating system and the user interface operating system 232 may operate in an Android™ operating environment to interface with the external device. Thus, the user interface operating system 232 may provide the diagnostic tool 100 with a common interface with an external device.

The user interface operating system 232 may communicate with external servers (not shown) to receive updates or modifications of various operating environments. The user interface operating system 232 may register the diagnostic tool 100 with the external servers (not shown) to receive updates or modifications. For example, the user interface operating system 232 may communicate with external servers of Apple, Google, Microsoft, Blackberry and/or other companies that develop the operating environment of the external devices in order to receive updates or modifications.

The vehicle diagnostic operating system 234 may include one or more computer processors and/or memory for storing various operating systems of the diagnostic tool 100. For example, the vehicle diagnostic operating system 234 may include various real-time operating systems (RTOS) that may serve real-time application requests. For example, the real-time operating systems (RTOS) may be able to process application requests as they come in, typically without buffering delays. The real-time operating systems (RTOS) may include, for example, Linux™, Unix™ QNX™ VxWorks™ and/or other real-time operating systems that may execute application requests of the diagnostic tool 100. The application requests executed by the vehicle diagnostic operating system 234 may include, for example, vehicle communication, diagnostic routines, diagnostic interpretation, failure mode explanation, data requests, data processing, and/or other real-time application requests.

The vehicle diagnostic operating system 234 may execute various application requests of the diagnostic tool 100 (e.g., processor 202) to perform the various diagnostic tests. For example, the vehicle diagnostic operating system 234 may receive an application request from the user interface operating system 232. In the event that the user interface operating system 232 and the vehicle diagnostic operating system 234 use different protocols, the vehicle diagnostic operating system 234 may translate the application request from the protocol of the user interface operating system 232 to the protocol used by the vehicle diagnostic operating system 234. Also, the vehicle diagnostic operating system 234 may be installed on a computer device of the user to operate the computer device to perform the various diagnostic tests. Different vehicle manufactures (or even within the same manufacture) may require the diagnostic tool 100 to operate using different programs and communication protocols. The diagnostic tool 100 may determine whether it is operating the correct software or program for a particular vehicle by comparing the vehicle type with the vehicle diagnostic operating system 234 currently running on the diagnostic tool 100. The vehicle type may be inputted into the diagnostic tool 100 through the user interface 106 in a manner such as, for example, scanning a bar coded VIN number located on the vehicle to be serviced, reading a radio frequency identification (RFID) device, or communicating with a wireless device of the vehicle. Also, the vehicle type may be manually inputted into the diagnostic tool 100 through the user interface in a manner such as, manually enter the VIN number. From the vehicle information, the diagnostic tool 100 can then determine whether it is presently running the necessary program to service the vehicle.

The altimeter 236 may be used to determine the altitude of the diagnostic tool 100. The altimeter 236 may be electronically coupled to the processor 202 and can provide the altitude or elevation of the diagnostic tool 100. The altimeter 236 may be coupled to a barometric pressure sensor (not shown) in order to calibrate the elevation measurements determined by the altimeter 236. The barometric pressure sensor can be positioned interior or exterior to the housing of the diagnostic tool 100. Minor atmospheric pressure changes can affect the accuracy of the altimeter 236, thus, diagnostic tool 100 can correct for these changes by using the barometric pressure sensor in conjunction with the altimeter 236 along with a correction factor.

Wireless communication circuit 238 may communicate with the processor via second system bus 222. The wireless communication circuit 238 may be configured to communicate to RF (radio frequency), satellites, near field communication (NFC), cellular phones (analog or digital), Bluetooth®, Wi-Fi, Infrared, Zigbee, Local Area Networks (LAN), WLAN (Wireless Local Area Network), or other wireless communication configurations and standards. The wireless communication circuit 238 may allow the diagnostic tool 100 to communicate with other devices wirelessly. The wireless communication circuit 238 may include an antenna and transceiver built therein and being housed within the housing 102 or can be externally located on the housing 102.

Figure 3:
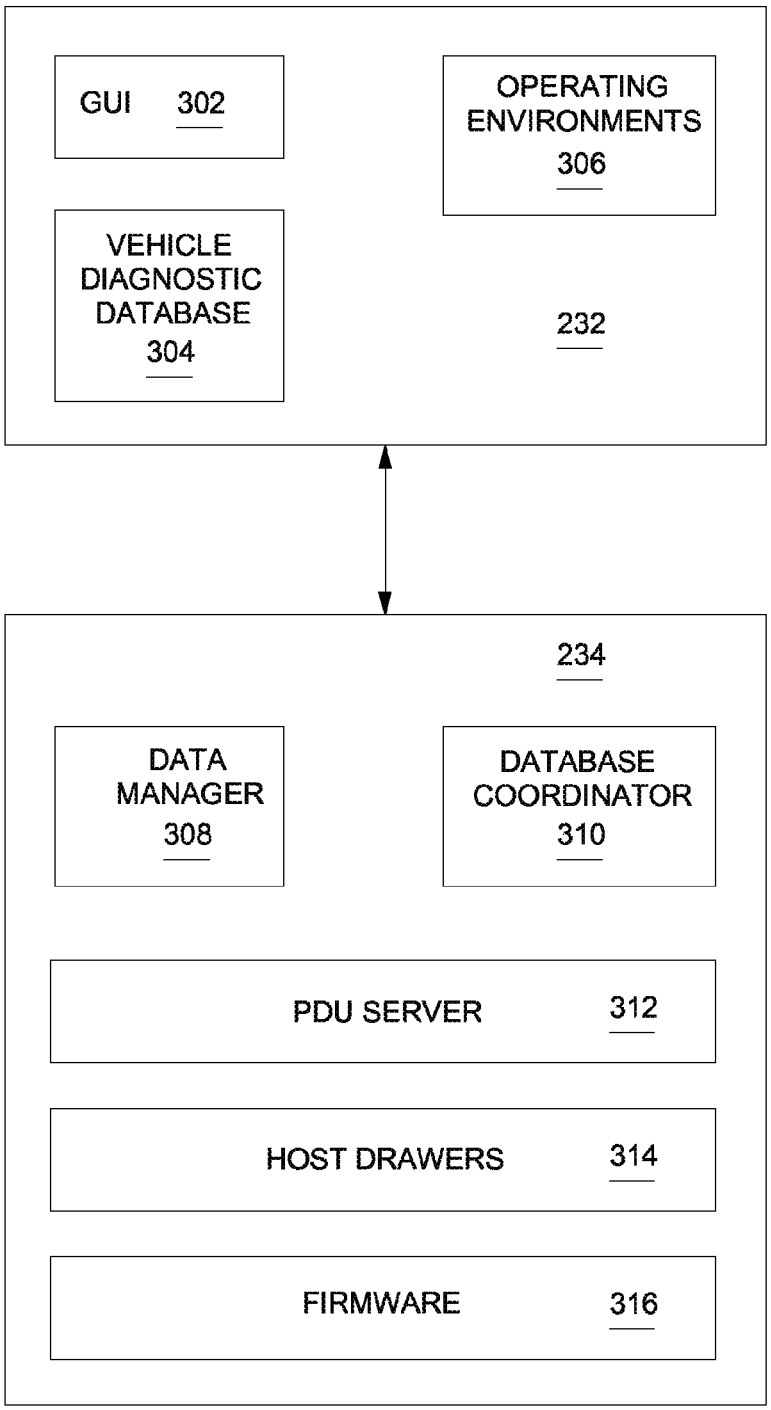
FIG. 3 depicts a system diagram of a diagnostic tool according to an exemplary embodiment of the present disclosure.

FIG. 3 illustrates a system diagram of a diagnostic tool 100 according to an embodiment of the present disclosure. As discussed above, the diagnostic tool 100 may include the user interface operating system 232 and the vehicle diagnostic operating system 234. The user interface operating system 232 may be communicatively coupled to the vehicle diagnostic operating system 234. The user interface operating system 232 may be communicatively coupled to an external device. For example, the external device may be provided as a graphical interface device to the diagnostic tool 100 to diagnose a vehicle. Different external devices may be operated under different operating systems and thus the user interface operating system 232 may select the operating system of the external device to communicate with the external device. Thus, the user interface operating system 232 may provide a communication channel between the external device and the diagnostic tool 100.

The user interface operating system 232 may include a graphical user interface (GUI) 302, a vehicle diagnostic database 304, and a plurality of operating environments 306. The graphical user interface (GUI) 302 may transmit information between the diagnostic tool 100 and the user or the external device. For example, the graphical user interface (GUI) 302 may include a separate or unified graphical user interface to communicate with the user and the external device. The graphical user interface (GUI) 302 may be communicatively coupled to the vehicle diagnostic database 304 and the plurality of operating environments 306. In an alternative embodiment, the vehicle diagnostic database 304 may be located at the vehicle diagnostic operating system 234 of the diagnostic tool 100. The graphical user interface (GUI) 302 may operate in one of the plurality of operating environments 306. For example, the graphical user interface (GUI) 302 may operate in an iOS™ operating environment or an Android™ operating environment. In other exemplary embodiments, the graphical user interface (GUI) 302 may operate in Window 8™ or Window RT™ operating environment.

The diagnostic tool 100 may be communicatively coupled to an external device operating in an environment. The graphical user interface (GUI) 302 may communicate with the external device via one or more communication messages. The graphical user interface (GUI) 302 may determine the operating environment of the external device based at least in part on the communication messages. In an exemplary embodiment, the graphical user interface (GUI) 302 may examine a header or payload of the data packet received from the external device in order to determine an operating environment of the external device. Thereafter, the graphical user interface (GUI) 302 may select to operate in the operating environment of the external device in order to provide a communication connection.

The vehicle diagnostic operating system 234 may include a data manager 308, a database coordinator 310, a protocol data unit (PDU) server 312, host drivers 314 and a firmware 316. The database coordinator 310 may be communicatively coupled to the vehicle diagnostic database 304. The database coordinator 310 may configure, upgrade, administer, monitoring and maintain the vehicle diagnostic database 304. The data manager 308 may be communicatively coupled to the graphical user interface (GUI) 302 to transmit data there between. For example, the graphical user interface (GUI) 302 may transmit one or more application requests and/or user data to the data manager 308. The data manager 308 may provide the data received from the graphical user interface (GUI) 302 to the protocol data unit (PDU) server 312. The protocol data unit (PDU) server 312 may process the data before providing the processed data to the host drivers 314. For example, the protocol data unit (PDU) server 312 may add additional information (e.g., port number to identify an application), a network address to route the information, a code to identify the type of data and/or other information to facilitate an execution of an application. Also, the protocol data unit (PDU) server 312 may convert the convert a protocol of the received information to a different protocol. For example, the received information may be using J1708 or J1587 protocol, the protocol data unit (PDU) server 312 may convert the received information to J2534 protocol in order to execute an application request.

The processed information may be transferred from the protocol data unit (PDU) server 312 to the host drivers 314. The host drivers may communicate with the firmware 316 to execute an application request. For example, the host drivers 314 may include a library of routines or commands. When the processed information invoke a routine in the host drivers 314, the host drivers 314 may issue commands to the firmware 316. The firmware 316 may provide control instructions to execute application requests based at least in part on the commands received from the host drivers 314.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A diagnostic tool, comprising:

a processor that operates the diagnostic tool;

a user interface operating system comprising a plurality of operating environments corresponding to operating systems of external devices, wherein the user interface operating system determines an external device's operating system and selects an operating environment from said plurality of operating environments corresponding to the operating system of the external device; and a vehicle diagnostic operating system that includes real time operating systems that serve application requests from the user interface operating system, wherein the application requests include a request to perform a diagnostic test.

2. The diagnostic tool of claim 1, wherein the operating environment is the same operating environment as the external device that is coupled to the diagnostic tool.

3. The diagnostic tool of claim 1, wherein the operating environment includes at least one of the following operating environments: iOS, Android, Window 8, Window RT or Blackberry 10.

4. The diagnostic tool of claim 1, wherein the real time operating systems include at least one of the following real time operating systems: Linux, Unix, QNX, or VxWorks.

5. The diagnostic tool of claim 1, wherein the user interface operating system comprises a graphical user interface operating with the external device.

6. The diagnostic tool of claim 1, wherein the user interface operating system further comprises a vehicle diagnostic database.

7. The diagnostic tool of claim 1, wherein the vehicle diagnostic operating system comprises a data manager coupled to the user interface operating system.

8. The diagnostic tool of claim 1, wherein the vehicle diagnostic operating system further comprises a database coordinator for managing a database of the user interface operating system.

9. The diagnostic tool of claim 1, wherein the vehicle diagnostic operating system further comprises a protocol data unit (PDU) server for processing data received from the user interface operating system.

10. The diagnostic tool of claim 9, wherein the protocol data unit (PDU) server is configured to add additional information to the data received from the user interface operating system.

11. The diagnostic tool of claim 9, wherein the protocol data unit (PDU) server is configured to convert data received from the user interface operation system from a first protocol to a second protocol.

12. The diagnostic tool of claim 1, wherein the vehicle diagnostic operating system further comprises host drivers.

13. The diagnostic tool of claim 1, wherein vehicle diagnostic operating system further comprises firmware.

14. A diagnostic tool comprising:

a user interface operating system comprising:

a plurality of operating environments corresponding to operating systems of external devices, wherein the user interface operating system determines an external device's operating system and selects an operating environment from the plurality of operating environments that corresponds to the determine operating system of the external device; and a computer processor that operates in a first operating environment, wherein the first operating environment corresponds to the determined operating system of the external device coupled to the diagnostic tool; and a vehicle diagnostic operating system comprising a computer processor that operates in a second operating environment, wherein the second operating environment is different from the first operating environment.

15. The diagnostic tool of claim 14, wherein the first operating environment includes at least one of the following operating environments: iOS, Android, Window 8, Window RT or Blackberry 10.

16. The diagnostic tool of claim 14, wherein the second operating environment includes at least one of the following operating environments: Linux, Unix, QNX, or VxWorks.

17. The diagnostic tool of claim 14, wherein the user interface operating system comprises a graphical user interface operating in the first operating environment.

18. The diagnostic tool of claim 14, wherein the vehicle diagnostic operating system further comprises a protocol data unit (PDU) server for processing data received from the user interface operating system.

19. The diagnostic tool of claim 18, wherein the protocol data unit (PDU) server is configured to convert the data received from the user interface operation system from a first protocol to a second protocol.

* * * * *